US012241135B2

(12) United States Patent
Kim et al.

(10) Patent No.: US 12,241,135 B2
(45) Date of Patent: Mar. 4, 2025

(54) HIGH-STRENGTH HOT-ROLLED STEEL SHEET HAVING EXCELLENT BLANKING PROPERTIES AND UNIFORMITY, AND MANUFACTURING METHOD THEREOF

(71) Applicant: POSCO, Pohang-si (KR)

(72) Inventors: Dong-Wan Kim, Gwangyang-si (KR); Sung-Il Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 867 days.

(21) Appl. No.: 17/429,855

(22) PCT Filed: Dec. 18, 2019

(86) PCT No.: PCT/KR2019/018007
§ 371 (c)(1),
(2) Date: Aug. 10, 2021

(87) PCT Pub. No.: WO2021/125386
PCT Pub. Date: Jun. 24, 2021

(65) Prior Publication Data

US 2022/0106656 A1 Apr. 7, 2022

(51) Int. Cl.
*C21D 8/02* (2006.01)
*C22C 38/00* (2006.01)
(Continued)

(52) U.S. Cl.
CPC ..... *C21D 8/0226* (2013.01); *C21D 8/0205* (2013.01); *C22C 38/002* (2013.01);
(Continued)

(58) Field of Classification Search
None
See application file for complete search history.

(56) References Cited

U.S. PATENT DOCUMENTS

2007/0272333 A1 11/2007 Kimijima et al.
2015/0232970 A1 8/2015 Kami et al.
(Continued)

FOREIGN PATENT DOCUMENTS

CN 104619876 A 5/2015
CN 106103770 A 11/2016
(Continued)

OTHER PUBLICATIONS

Japanese Office Action dated Oct. 4, 2022 issued in Japanese Patent Application No. 2021-547716.
(Continued)

*Primary Examiner* — Anthony M Liang
(74) *Attorney, Agent, or Firm* — Morgan, Lewis & Bockius LLP

(57) ABSTRACT

The present invention provides a steel sheet comprising by weight: C: 0.10-0.30%; Si: 0.001-1.0%; Mn: 0.5-2.5%; Cr: 0.001-1.5%; Mo: 0.001-0.5%; Al: 0.001-0.5%; P: 0.001-0.01%; S: 0.001-0.01%; N: 0.001-0.01%; B: 0.0001-0.004%; Ti: 0.001-0.1%; Nb: 0.001 to 0.1%; and the balance consisting of Fe and inevitable impurities, and satisfying relational expression (1), and a microstructure includes comprising: a martensite phase; a bainite phase, wherein the fraction of the martensite phase is 50-90%, the fraction of the bainite phase is 5-50%, the sum of the fractions of the martensite phase and the bainite phase is 90% or more; and the balance consisting of a ferrite phase.

$CL<1$, [Relationship Expression (1)]

$CL=-0.692-0.158\times[Mn]+0.121\times[Mn]^2+0.061\times[Cr]^2-0.319\times[Mo]+0.035\times[Hardness_HRC]$ (where CL is an effective cracking index, [Mn], [Cr] and [Mo] are the
(Continued)

percentages by weight of respective corresponding alloy elements, and [Hardness_HRC] is a Rockwell hardness (HRC).)

6 Claims, 1 Drawing Sheet

(51) Int. Cl.

| | |
|---|---|
| ***C22C 38/02*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |

(52) U.S. Cl.

CPC ..... *C22C 38/02* (2013.01); *C22C 38/06* (2013.01); *C22C 38/22* (2013.01); *C22C 38/28* (2013.01); *C22C 38/32* (2013.01); *C22C 38/38* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2016/0273066 | A1* | 9/2016 | Sakakibara ..... | C23C 2/06 |
| 2017/0009316 | A1 | 1/2017 | Yamazake et al. | |
| 2017/0107591 | A1 | 4/2017 | Takashima et al. | |
| 2018/0237874 | A1 | 8/2018 | Yamazaki et al. | |
| 2020/0239976 | A1 | 7/2020 | Seo et al. | |

FOREIGN PATENT DOCUMENTS

| | | | |
|---|---|---|---|
| CN | 106164313 | A | 11/2016 |
| CN | 110088341 | A | 8/2019 |
| EP | 1375694 | A1 | 1/2004 |
| EP | 2998414 | A1 | 3/2016 |
| EP | 3112488 | A1 | 1/2017 |
| EP | 3296415 | A1 | 3/2018 |
| JP | H11-302781 | A | 11/1999 |
| JP | 2000-109951 | A | 4/2000 |
| JP | 2004-536965 | A | 12/2004 |
| JP | 2007-332438 | A | 12/2007 |
| JP | 2009-041083 | A | 2/2009 |
| JP | 2013-108154 | A | 6/2013 |
| KR | 10-2004-0013156 | A | 2/2004 |
| KR | 10-2013-0046942 | A | 5/2013 |
| KR | 10-2015-0017252 | A | 2/2015 |
| KR | 10-2018-0018803 | A | 2/2018 |
| KR | 10-2020-0037485 | A | 4/2020 |
| KR | 10-2109272 | B1 | 5/2020 |
| WO | 2003/010351 | A1 | 2/2003 |
| WO | 2017/017933 | A1 | 2/2017 |

OTHER PUBLICATIONS

Extended European Search Report dated Nov. 24, 2022 issued in European Patent Application No. 19956797.5.

International Search Report dated Sep. 11, 2020 issued in International Patent Application No. PCT/KR2019/018007 (with English translation).

Chinese Office Action dated May 5, 2022 issued in Chinese Patent Application No. 201980094105.9.

* cited by examiner

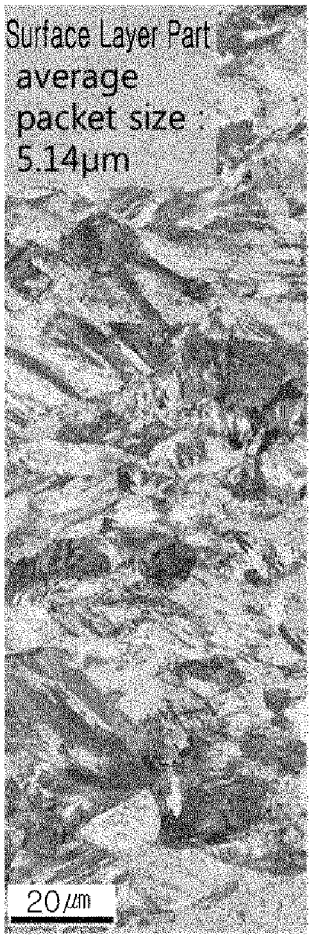
Surface Layer Part
average
packet size :
5.14μm
20μm
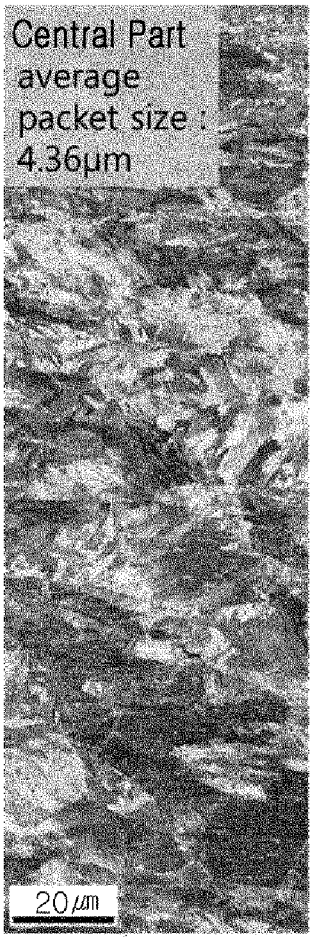
Central Part
average
packet size :
4.36μm
20μm
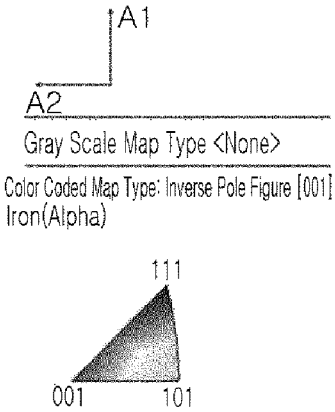
A1
A2
Gray Scale Map Type <None>
Color Coded Map Type: Inverse Pole Figure [001]
Iron(Alpha)
111
001
101

HIGH-STRENGTH HOT-ROLLED STEEL SHEET HAVING EXCELLENT BLANKING PROPERTIES AND UNIFORMITY, AND MANUFACTURING METHOD THEREOF

CROSS-REFERENCE OF RELATED APPLICATIONS

This application is the U.S. National Phase under 35 U.S.C. § 371 of International Patent Application No. PCT/KR2019/018007, filed on Dec. 18, 2019, the entire disclosure of which application is incorporated by reference herein.

TECHNICAL FIELD

The present disclosure relates to a high-strength hot-rolled steel sheet having excellent blanking properties and uniformity with a tensile strength of 1100 MPa or more and a surface hardness of 35 HRC or more, and a method of manufacturing the same.

BACKGROUND ART

Related art chains and mechanical parts are manufactured by a spheroidizing heat treatment and a Quenching and Tempering (QT) heat treatment using high carbon steel and high carbon alloy steel. However, this repetitive heat treatment process causes carbon dioxide emissions and pollution, and increases the manufacturing cost of chains and machine parts. Therefore, in order to improve this, a technology capable of securing target strength and hardness without additional heat treatment has been proposed by using low-carbon steel to manufacture low-temperature transformation steel having bainite and martensite as a matrix structure.

Patent Document 1 proposes a technique for securing target strength and hardness by hot rolling the steel and then immediately after that, and manufacturing to form bainite and martensite according to specific cooling conditions.

In addition, Patent Document 2 proposes a method for securing surface hardness based on the C—Si—Mn—Ni—B component system.

However, such high-strength steels have a problem in that cracks occur in the rolled sheet material after punching when punch molding is performed in the process of manufacturing chains and mechanical parts. In detail, Si, Mn, Mo, Cr, V, Cu or Ni alloy components, which are mainly used to secure high strength and hardness, may be locally segregated or cause non-uniformity of microstructure, resulting in inferior blanking properties, and fatigue fractures may easily occur in areas in which components are segregated and microstructure are non-uniform when used. In addition, since steel with high hardenability is sensitive to changes in microstructure during cooling, the low-temperature transformation tissue phase is formed non-uniformly, further reducing blanking properties. In order to improve this, the introduction of an additional heat treatment process may be considered, but the introduction of such an additional heat treatment process is economically disadvantageous, and there is no differentiation from the existing high-carbon steel and high-carbon alloy steel processes, and thus, the application thereof in practice may be difficult.

PRIOR ART DOCUMENT (Patent Document 1) European Patent Application Publication No. 1375694

(Patent Document 2) Japanese Patent Laid-Open Publication No. 1999-302781

DISCLOSURE

Technical Problem

An aspect of the present disclosure is to provide a high-strength hot-rolled steel sheet and a method of manufacturing the same, in which a microstructure having excellent blanking properties while having high strength by optimizing alloy composition, rolling temperature and cooling rate may be obtained uniformly over the entire length and width thereof, thereby exhibiting excellent blanking properties and uniformity.

On the other hand, the subject of this invention is not limited to the above-mentioned content. The subject of the present disclosure will be understood from the overall content of the present specification, and those of ordinary skill in the art to which the present disclosure pertains will have no difficulty in understanding the additional subject of the present disclosure.

Technical Solution

According to an aspect of the present disclosure, a high-strength hot-rolled steel sheet comprises, by weight %, C: 0.10 to 0.30%, Si: 0.001 to 1.0%, Mn: 0.5 to 2.5%, Cr: 0.001 to 1.5%, Mo: 0.001 to 0.5%, Al: 0.001 to 0.5%, P: 0.001 to 0.01%, S: 0.001 to 0.01%, N: 0.001 to 0.01%, B: 0.0001 to 0.004%, Ti: 0.001 to 0.1%, and Nb: 0.001 to 0.1%, comprises a balance of iron and unavoidable impurities, and satisfies the following Relationship Expression (1), wherein a microstructure, a main phase consists of a martensite phase and a bainite phase, a fraction of the martensite phase is 50% or more and less than 90%, a fraction of the bainite phase is 5% or more and 50% or less, a sum of the fractions of the martensite phase and the bainite phase is 90% or more, and a remainder is a ferrite phase.

$$CL<1,$$

$$CL=-0.692-0.158\times[Mn]+0.121\times[Mn]^2+0.061\times[Cr]^2-0.319\times[Mo]+0.035\times[Hardness_HRC], \quad \text{[Relationship Expression (1)]}$$

where CL is an effective cracking index, [Mn], [Cr] and [Mo] are weight % of a corresponding alloying element, and [Hardness_HRC] is a Rockwell hardness (HRC).

In the high-strength hot-rolled steel sheet, an average packet size of the martensite phase may be 1 to 7 μm in a circle-equivalent diameter, an aspect ratio of a packet structure of the martensite phase may be 1 to 5 in a central part (t/4 to t/2) in a thickness direction and may be 1.1 to 6 in a surface layer part (surface layer to t/8) in the thickness direction, and a value obtained by dividing the aspect ratio of the surface layer part by the aspect ratio of the central part may be 0.9 to 2.

The high-strength hot-rolled steel sheet may have a tensile strength of 1100 MPa or more and a surface hardness of 35 HRC or more.

When the tensile strength and the surface hardness were measured at 9 sites in a total width and 3 sites in a total length of a coiled hot-rolled steel sheet, a difference between a maximum value and a minimum value of each measurement result may be within 140 MPa of tensile strength and within 4 HRC of surface hardness.

According to another aspect of the present disclosure, a method of manufacturing a high-strength hot-rolled steel sheet includes: reheating a steel slab satisfying the Relationship Expression (1) above, to 1180-1350° C., the steel slab comprising, by weight %, C: 0.10 to 0.30%, Si: 0.001 to 1.0%, Mn: 0.5 to 2.5%, Cr: 0.001 to 1.5%, Mo: 0.001 to 0.5%, Al: 0.001 to 0.5%, P: 0.001 to 0.01%, S: 0.001 to 0.01%, N: 0.001 to 0.01%, B: 0.0001 to 0.004%, Ti: 0.001 to 0.1%, Nb: 0.001 to 0.1%, and balances of iron and unavoidable impurities; hot rolling the reheated steel slab to satisfy the following Relationship Expression (2); cooling a hot-rolled steel sheet to a temperature in a range of 0 to 400° C. to satisfy the following Relationship (3); and coiling the cooled steel sheet at a temperature in the range of 0 to 400° C., $$Tn-70 \leq FDT \leq Tn,$$

$$Tn=967-280\times[C]+35.7\times[Si]-28.1\times[Mn]-11.4\times[Cr]+11.4\times[Mo]-62\times[Ti]+46.2\times[Nb], \quad \text{[Relationship Expression (2)]}$$

where Tn is a critical rolling temperature (° C.), FDT is a rolling finishing temperature (° C.), and [C], [Si], [Mn], [Cr], [Mo], [B], [Nb] and [Ti] are weight % of a corresponding alloying element, and $$LCR \leq CR \leq HCR,$$

$$LCR=2000/(-1076+2751\times[C]+17\times[Si]+301\times[Mn]+330\times[Cr]+355\times[Mo]+42939\times[B])$$

$$HCR=2500/(-70.3+198\times[C]+32.0\times[Si]+16.7\times[Mn]+18.4\times[Cr]+42.1\times[Mo]+5918\times[B]), \quad \text{[Relationship Expression (3)]}$$

where CR is a cooling rate (° C./s) in a cooling zone, LCR is a minimum critical cooling rate (° C./s), a minimum value thereof is 5 and a maximum value thereof is 45, HCR is a maximum critical cooling rate (° C./s), a minimum value thereof is 50 and a maximum value thereof is 200, and [C], [Si], [Mn], [Cr], [Mo] and [B] are weight % of a corresponding alloying element.

After the coiling, the high-strength hot-rolled steel sheet may be pickled and then lubricated.

Advantageous Effects

According to an exemplary embodiment, by optimizing the alloy composition, rolling temperature and cooling rate, a microstructure having excellent blanking properties as compared to high strength is obtained uniformly over the entire length and width, thereby providing a high-strength hot-rolled steel sheet having excellent blanking properties and uniformity and a method of manufacturing the same.

DESCRIPTION OF DRAWINGS

FIG. 1 is an EBSD image illustrating a microstructure of a surface layer part and a central part of Inventive Steel 3.

BEST MODE FOR INVENTION

High-Strength Hot-Rolled Steel Sheet

Hereinafter, a high-strength hot-rolled steel sheet according to an exemplary embodiment of the present disclosure will be described in detail.

A high-strength hot-rolled steel sheet according to an exemplary embodiment of the present disclosure includes, by weight %, C: 0.10 to 0.30%, Si: 0.001 to 1.0%, Mn: 0.5 to 2.5%, Cr: 0.001 to 1.5%, Mo: 0.001 to 0.5%, Al: 0.001 to 0.5%, P: 0.001 to 0.01%, S: 0.001 to 0.01%, N: 0.001 to 0.01%, B: 0.0001 to 0.004%, Ti: 0.001 to 0.1%, and Nb: 0.001 to 0.1%, and includes a balance of iron and unavoidable impurities, satisfying Relationship Expression (1) below, wherein a microstructure of the high-strength hot-rolled steel sheet, a main phase consists of a martensite phase and a bainite phase, a fraction of the martensite phase is 50% or more and less than 90%, a fraction of the bainite phase is 5% or more and 50% or less, a sum of the fractions of the martensite phase and the bainite phase is 90% or more, and a remainder thereof is a ferrite phase.

$$CL<1,$$

$$CL=-0.692-0.158\times[Mn]+0.121\times[Mn]^2+0.061\times[Cr]^2-0.319\times[Mo]+0.035\times[Hardness_HRC], \quad \text{[Relationship Expression (1)]}$$

where CL is the effective cracking index, [Mn], [Cr] and [Mo] are the weight % of the corresponding alloying element, and [Hardness_HRC] is the Rockwell hardness (HRC).

First, an alloy composition of the high-strength hot-rolled steel sheet according to an exemplary embodiment of the present disclosure will be described in detail.

Hereinafter, the unit of each alloy element is weight %.

C: 0.10-0.30%

C is the most economical and effective element for reinforcing steel, and as the amount added increases, the fraction of ferrite phase decreases, and bainite and martensite phases with high hardness may be obtained due to the solid solution strengthening effect. However, if the content thereof is less than 0.10%, it may be difficult to obtain a sufficient reinforcing effect, and if the content exceeds 0.30%, the martensite phase having an excessively hard and low brittleness characteristic is formed, and there is a problem in that the blanking properties is lowered. Accordingly, the C content may be 0.10 to 0.30%. The upper limit of C may preferably be 0.25%, more preferably 0.23%. The lower limit of C may preferably be 0.15%, more preferably 0.17%.

Si: 0.001-1.0%

Si deoxidizes molten steel and has a solid solution strengthening effect, and may be advantageous in improving blanking properties by delaying the formation of coarse carbides. However, if the content is less than 0.001%, it may be difficult to obtain the above effect, and if the content thereof exceeds 1.0%, red scale is formed on the surface of the steel sheet during hot rolling, resulting in significantly poor quality of the steel sheet surface and lowering the surface hardness. Therefore, it may be preferable to limit the content thereof to 1.0% or less. Accordingly, the Si content may be 0.001 to 1.0%. The upper limit of Si may preferably be 0.7%, more preferably 0.5%. The lower limit of Si may preferably be 0.003%, more preferably 0.005%.

Mn: 0.5-2.5%

Mn is an effective element for solid-solution strengthening of steel, and increases the hardenability of the steel and suppresses the formation of ferrite upon cooling, thereby increasing the strength and hardness of the steel. However, if the content thereof is less than 0.5%, the above effect due to the addition thereof may not be obtained, and if the content exceeds 2.5%, the segregation part is greatly developed at the thickness center during a continuous casting process of the slab, and when cooling after hot rolling, the microstructure in the thickness direction is formed non-uniformly, resulting in inferior blanking properties. Accordingly, the Mn content may be 0.5 to 2.5%. The upper limit of Mn may preferably be 2.2%, more preferably 2.0%. The lower limit of Mn may preferably be 0.8%, more preferably 1.0%.

Cr: 0.001-1.5%

Cr is an element for solid-solution strengthening of steel and increases hardenability of steel to suppress ferrite formation, thereby increasing the strength and hardness of steel. However, if the Cr content is less than 0.001%, the above effect obtained due to the addition thereof cannot be obtained, and if the content thereof exceeds 1.5%, segregation in the center in the thickness direction is greatly developed, and the microstructure in the thickness direction is non-uniform, resulting in inferior blanking properties. Accordingly, the Cr content may be 0.001 to 1.5%. The upper limit of Cr may preferably be 1.2%, more preferably 1.0%. The lower limit of Cr may preferably be 0.003%, more preferably 0.005%.

Mo: 0.001-0.5%

Mo serves to improve blanking properties by strengthening the grain boundary and to increase the strength of steel by improving the hardenability of the steel. However, when the content is less than 0.001%, the effect is insignificant, and when the content is in excess of 0.5%, the effect is saturated and the manufacturing cost of the steel is greatly increased. Therefore, the Mo content may be 0.001 to 0.5%. The upper limit of Mo may preferably be 0.45%, more preferably 0.4%. The lower limit of Mo may preferably be 0.003%, more preferably 0.005%.

Al: 0.001-0.5%

Al is a component added for deoxidation, and if the content thereof in the dissolved state is less than 0.001%, the deoxidation effect is not sufficient. If the content thereof exceeds 0.5%, defects are likely to occur due to the formation of inclusions, and there is a problem causing nozzle clogging during continuous casting. Accordingly, the Al content may be 0.001 to 0.5%. The upper limit of Al may preferably be 0.45%, more preferably 0.4%. The lower limit of Al may preferably be 0.003%, more preferably 0.005%.

P: 0.001-0.01%

P is an impurity unavoidably contained in steel, and it may be advantageous to control the content thereof as low as possible. However, in order to enable the P content to be less than 0.001%, a lot of manufacturing cost is required, and thus, it may be economically disadvantageous. If the content exceeds 0.01%, brittleness occurs due to grain boundary segregation, thereby deteriorating blanking properties of the steel. Therefore, the P content may be 0.001 to 0.01%. The upper limit of P may preferably be 0.008%, more preferably 0.007%. The lower limit of P may preferably be 0.002%, more preferably 0.003%.

S: 0.001-0.01%

S is an impurity present in steel, and if the content thereof exceeds 0.01%, S is combined with Mn or the like and thus, it may be easy to form non-metallic inclusions, which causes a decrease in blanking properties of the steel. In addition, in order to enable the content thereof to be less than 0.001%, the time and cost are excessively consumed during the steelmaking operation, resulting in lower productivity. Accordingly, the S content may be 0.001 to 0.01%. The upper limit of S may preferably be 0.008%, more preferably 0.007%. The lower limit of S may preferably be 0.002%, more preferably 0.003%.

N: 0.001 to 0.01%

N is a solid solution strengthening element. In order to enable the content thereof to be less than 0.001%, it takes a lot of time and money during steelmaking and productivity is reduced, and if the content thereof exceeds 0.01%, a large amount of inclusions that adversely affect blanking properties during production are generated. Therefore, in the present disclosure, the N content may be 0.001 to 0.01%. The upper limit of N may preferably be 0.008%, more preferably 0.007%. The lower limit of N may preferably be 0.002%, more preferably 0.003%.

B: 0.0001-0.004%

B is an element increasing the hardenability of steel to facilitate securing of martensite and bainite phases, and the effect thereof is known to be excellent compared to other elements. However, if the content is less than 0.0001%, it may be difficult to obtain a sufficient hardenability synergistic effect, and if the content thereof exceeds 0.004%, the hardenability synergistic effect is saturated, and thus, it may be difficult to expect an increase in hardenability by additional addition. Accordingly, the B content may be 0.0001 to 0.004%. The upper limit of B may preferably be 0.0035%, more preferably 0.003%. The lower limit of B may preferably be 0.0003%, more preferably 0.0005%.

Ti: 0.001-0.1%

Ti has a precipitation strengthening effect through the generation of TiC, and has a strong affinity with N to form coarse TiN in steel, and has the effect of improving the hardenability of steel by suppressing the formation of BN. However, if the content of Ti is less than 0.001%, the above effect cannot be sufficiently obtained, and if the content of Ti exceeds 0.1%, there is a problem in that the blanking properties are deteriorated during molding due to coarsening of the precipitates. Therefore, in the present disclosure, the Ti content may be 0.001 to 0.1%. The upper limit of Ti may preferably be 0.08%, more preferably 0.07%. The lower limit of Ti may preferably be 0.003%, more preferably 0.005%.

Nb: 0.001-0.1%

Nb is a representative precipitation strengthening element, and precipitates during hot rolling to contribute to the improvement of strength, hardness and blanking properties of steel due to the effect of grain refinement due to delayed recrystallization. At this time, if the content of Nb is less than 0.001%, the above effect cannot be sufficiently obtained, and if the content of Nb exceeds 0.1%, blanking properties is reduced due to the formation of coarse complex precipitates. Therefore, in the present disclosure, the Nb content may be 0.001 to 0.1%. The upper limit of Nb may preferably be 0.08%, more preferably 0.07%. The lower limit of Nb may preferably be 0.003%, more preferably 0.005%.

In the high-strength hot-rolled steel sheet according to an exemplary embodiment of the present disclosure, in addition to the above-mentioned alloying elements, the remainder is iron (Fe). However, in the normal manufacturing process, unintended impurities from raw materials or the surrounding environment may inevitably be mixed, and thus, it cannot be excluded. Since these impurities are known to those skilled in the art, all details thereof are not described in detail.

In addition, the high-strength hot-rolled steel sheet according to an exemplary embodiment of the present disclosure satisfies the above-described alloy composition, and also satisfies the following Relation Expression (1) to secure blanking properties.

$$CL<1,$$

$$CL=-0.692-0.158\times[Mn]+0.121\times[Mn]^2+0.061\times[Cr]^2-0.319\times[Mo]+0.035\times[Hardness_HRC], \quad \text{[Relationship Expression (1)]}$$

where CL is the effective cracking index, [Mn], [Cr] and [Mo] are the weight % of the corresponding alloy element, and [Hardness_HRC] is the Rockwell hardness (HRC).

In the above Relationship Expression (1), the effective cracking index (CL) is an index indicating the blanking characteristics of steel. When this value is 1 or more, it may be determined that a crack of an effective size that leads to a fatal defect occurs in the punched surface of the steel. The blanking properties of steel are affected by segregation according to the content of alloying elements, and the contents of Mn and Cr, which are mainly included in large amounts in the steel and are known to cause segregation in the continuous casting process, are major indicators related thereto. As the content of Mn and Cr increases, blanking properties is deteriorated due to segregation by exceeding linear tendency. Thus, CL increases in proportion to the square value of Mn and Cr, and a segregation phenomenon should not be exacerbated by controlling the content of the two components. In addition, as the hardness of the steel increases, the toughness decreases, and thus the blanking properties tend to deteriorate. Therefore, it is necessary to derive an optimal component system that does not deteriorate the blanking characteristics of steel while producing a high-hardness hot-rolled product at the target level, and this is reflected in Relationship Expression (1). In detail, when Mo was added, it was confirmed that the hardenability of the steel was greatly increased, and structural uniformity in the steel was increased, such that relatively higher blanking properties could be secured even at the same hardness, and this is added to Relationship Expression (1).

On the other hand, in the microstructure of the high-strength hot-rolled steel sheet according to an exemplary embodiment of the present disclosure, the main phase consists of a martensite phase and a bainite phase, the fraction of the martensite phase is 50% or more and less than 90%, and the fraction of the bainite phase is 5% or more and 50% or less. The sum of the fractions of the martensite phase and the bainite phase may be 90% or more, and the balance may consist of a ferrite phase. In addition, the average packet size of the martensite phase is 1 to 7 μm in a circle-equivalent diameter, and the aspect ratio of the packet structure of the martensite phase may be 1 to 5 in a central part (t/4 to t/2) in the thickness direction, and may be 1.1 to 6 in the surface layer part (surface layer to t/8) in the thickness direction, and the value obtained by dividing the aspect ratio of a surface layer part by the aspect ratio of the central part may be 0.9-2.

First, in the microstructure of the high-strength hot-rolled steel sheet according to an exemplary embodiment of the present disclosure, the main phase consists of a martensite phase and a bainite phase, and in this case, the fraction of the martensite phase may be 50% or more and less than 90%. If the fraction of the martensite phase is less than 50%, the fraction of the ferrite/bainite phase having a relatively low hardness increases, and thus the target hardness may not be secured. On the other hand, if the fraction of the martensite phase is 90% or more, the toughness of the steel is significantly insufficient, and it may be difficult to secure target blanking characteristics. Therefore, it may be preferable to limit the fraction of the martensite phase to 50% or more and less than 90%.

On the other hand, the fraction of the bainite phase may be 5% or more and 50% or less. The bainite phase has a slightly lower hardness than that of the martensite phase, but has a similar level thereto, and the degree of contribution of the bainite phase to blanking properties during production is superior to that of the martensite phase, and thus, it is necessary to include at least 5% or more of bainite phase to maintain the balance of hardness and blanking properties. However, if the fraction thereof exceeds 50%, it may be difficult to satisfy the target hardness, and thus, a maximum value thereof is limited to 50% or less. Therefore, it may be preferable to limit the fraction of the bainite phase to 5% or more and 50% or less.

In addition, the sum of the fractions of the martensite phase and the bainite phase may be 90% or more, and the remainder may consist of a ferrite phase. If the fraction of the ferrite phase, which is the remainder except for the martensite phase and the bainite phase, is 10% or more, the blanking property is reduced due to the difference in hardness between the phases at the ferrite-martensite interface, and thus, the fraction of the ferrite phase may be preferably limited to less than 10%.

On the other hand, it may more preferable be that the martensite phase is the main phase among the martensite phase and the bainite phase, and the fraction thereof is 75% or more. In addition, the microstructure of the hot-rolled steel sheet according to an exemplary embodiment of the present disclosure may consist of only a martensite phase and a bainite phase without a ferrite phase.

The average packet size of the martensite phase, among the microstructures according to an exemplary embodiment of the present disclosure, may be 1 to 7 μm in a circle-equivalent diameter. In this case, the packet of the martensite phase indicates adjacent structures having the same azimuthal texture in martensite, and the average size thereof may be defined by obtaining the circle-equivalent diameter of microstructures showing the same direction through SEM measurement to obtain the average value, or by specifying the size of microstructures having the same azimuth relationship through EBSD measurement or the like. The average packet size is preferably measured at the central portion of the steel sheet, and may also be measured by other well-known methods well known in the related art. By controlling the average packet size of the martensite phase in the microstructures of the manufactured steel to be 1 to 7 μm in a circle-equivalent diameter, the blanking properties of the steel may be increased through grain refinement. If the average packet size thereof is less than 1 μm, an excessive rolling load occurs in the hot rolling process for grain refinement, whereas if the average packet size thereof exceeds 7 μm, it may be difficult to expect an effect of increasing hardness through grain refinement. Therefore, it may be preferable that the average packet size of the martensite phase is 1 to 7 μm in a circle-equivalent diameter.

In addition, in the microstructure according to an exemplary embodiment of the present disclosure, the aspect ratio of the packet structure of the martensite phase may be 1 to 5 in the central part (t/4 to t/2) in the thickness direction, and may be 1.1-6 in the surface layer part (surface layer to t/8) in the thickness direction, and the value obtained by dividing the aspect ratio of the surface layer part by the aspect ratio of the central part may be 0.9-2. In this case, the aspect ratio of the packet structure of the martensite phase may be defined as a value obtained by dividing a long axis of an oval by a short axis thereof by simplifying adjacent microstructures having the same azimuthal texture in the form of the oval in martensite.

If the aspect ratio of the packet structure of the martensite phase is less than 1 in the central part (t/4 to t/2) in the thickness direction, the crystal grain refinement effect due to the recrystallization delay is insufficient to increase the hardness, whereas if the aspect ratio exceeds 5, partial recrystallization occurs up to the central part of the steel and blanking properties are deteriorated due to material deviation of the steel in the thickness direction.

On the other hand, if the aspect ratio is less than 1.1 in the surface layer part (surface layer to t/8) in the thickness direction, the recrystallization delay phenomenon by rolling hardly occurs even in the surface layer, and thus, the surface hardening effect to obtain the target hardness is insufficient. On the other hand, if the value exceeds 6, excessive partial recrystallization occurs in the surface layer, causing deterioration of blanking properties due to material deviation in the thickness direction.

In addition, if the value obtained by dividing the aspect ratio of the surface layer part by the aspect ratio of the central part is less than 0.9, the hardening effect of the surface layer due to recrystallization delay is insufficient, and if the value exceeds 2, the blanking characteristics are deteriorated due to material deviation in the thickness direction.

Therefore, it may be preferable that the aspect ratio of the packet structure of the martensite phase is 1 to 5 in the central part (t/4 to t/2) in the thickness direction and is 1.1 to 6 in the surface layer part (surface layer to t/8) in the thickness direction, and the value obtained by dividing the aspect ratio of the surface layer part by the aspect ratio of the central part is 0.9 to 2.

On the other hand, the high-strength hot-rolled steel sheet according to an exemplary embodiment of the present disclosure has a tensile strength of 1100 MPa or more and a surface hardness of 35 HRC or more. In detail, it may be preferable that when the tensile strength and the surface hardness were measured at 9 sites in the total width and 3 sites in the total length of the coiled hot-rolled steel sheet, the difference between a maximum value and a minimum value of each measurement result is within 140 MPa of tensile strength and within 4 HRC of surface hardness. In this case, the 9 sites of the total width indicates selecting 9 portions of the coiled hot-rolled steel sheet, and the 3 sites of the total length indicates selecting 3 portions of the coiled hot-rolled steel sheet in the longitudinal direction.

Method of Manufacturing High-Strength Hot-Rolled Steel Sheet

Hereinafter, a method of manufacturing a high-strength hot-rolled steel sheet according to another embodiment of the present disclosure will be described in detail.

A method of manufacturing a high-strength hot-rolled steel sheet according to another embodiment of the present disclosure includes reheating a steel slab satisfying the following Relationship Expression (1) to 1180-1350° C., the steel slab comprising, by weight %, C: 0.10 to 0.30%, Si: 0.001 to 1.0%, Mn: 0.5 to 2.5%, Cr: 0.001 to 1.5%, Mo: 0.001 to 0.5%, Al: 0.001 to 0.5%, P: 0.001 to 0.01%, S: 0.001 to 0.01%, N: 0.001 to 0.01%, B: 0.0001 to 0.004%, Ti: 0.001 to 0.1%, Nb: 0.001 to 0.1%, and balances of iron and unavoidable impurities; hot rolling the reheated steel slab to satisfy the following Relationship Expression (2); cooling a hot-rolled steel sheet to a temperature in a range of 0 to 400° C. to satisfy the following Relationship Expression (3); and coiling the cooled steel sheet at a temperature in a range of 0 to 400° C.

$$CL<1,$$

$$CL=-0.692-0.158\times[Mn]+0.121\times[Mn]^2+0.061\times[Cr]^2-0.319\times[Mo]+0.035\times[Hardness_HRC] \quad \text{[Relationship Expression (1)]}$$

where CL is an effective cracking index, [Mn], [Cr] and [Mo] are weight % of a corresponding alloying element, and [Hardness_HRC] is a Rockwell hardness (HRC).

$$Tn-70\leq FDT\leq Tn$$

$$Tn=967-280\times[C]+35.7\times[Si]-28.1\times[Mn]-11.4\times[Cr]+11.4\times[Mo]-62\times[Ti]+46.2\times[Nb], \quad \text{[Relationship Expression (2)]}$$

where Tn is a critical rolling temperature (° C.), FDT is a rolling finishing temperature (° C.), and [C], [Si], [Mn], [Cr], [Mo], [B], [Nb] and [Ti] are weight % of a corresponding alloying element.

$$LCR\leq CR\leq HCR$$

$$LCR=2000/(-1076+2751\times[C]+17\times[Si]+301\times[Mn]+330\times[Cr]+355\times[Mo]+42939\times[B])$$

$$HCR=2500/(-70.3+198\times[C]+32.0\times[Si]+16.7\times[Mn]+18.4\times[Cr]+42.1\times[Mo]+5918\times[B]), \quad \text{[Relationship Expression (3)]}$$

where CR is a cooling rate (° C./s) in a cooling zone, LCR is a minimum critical cooling rate (° C./s), a minimum value thereof is 5 and a maximum value thereof is 45, HCR is a maximum critical cooling rate (° C./s), a minimum value thereof is 50 and a maximum value thereof is 200, and [C], [Si], [Mn], [Cr], [Mo] and [B] are weight % of a corresponding alloying element.

Reheating Slab

First, a steel slab having the above-described alloy composition and satisfying the above relationship expression (1) is reheated at a temperature of 1180 to 1350° C. In this case, if the reheating temperature is less than 1180° C., the precipitates are not sufficiently re-dissolved, and thus, the formation of precipitates in the process after hot rolling is reduced, coarse TiN remains, and it may be difficult to solve the segregation generated during continuous casting by diffusion. In addition, if the temperature exceeds 1350° C., strength decreases and non-uniformity of structure occurs due to abnormal grain growth of austenite grains. Therefore, the reheating temperature may preferably be limited to 1180 to 1350° C.

Hot Rolling

The reheated slab is hot-rolled at a temperature in the range of 750 to 1000° C. If hot rolling is started at a high temperature exceeding 1000° C., the temperature of the hot-rolled steel sheet increases, resulting in coarse grain size and insufficient descaling, and thereby, resulting in poor surface quality of the hot-rolled steel sheet. In addition, if the rolling is finished at a temperature of less than 750° C., the recrystallization behavior of the steel is different for respective locations, the material is not uniform, and the blanking properties are deteriorated.

In addition, the hot rolling is performed to satisfy the following Relationship Expression (2) for the rolling finishing temperature (FDT).

$$Tn-70\leq FDT\leq Tn$$

$$Tn=967-280\times[C]+35.7\times[Si]-28.1\times[Mn]-11.4\times[Cr]+11.4\times[Mo]-62\times[Ti]+46.2\times[Nb], \quad \text{[Relationship Expression (2)]}$$

where Tn is the critical rolling temperature (° C.), FDT is the rolling finishing temperature (° C.), [C], [Si], [Mn], [Cr], [Mo], [B], [Nb] and [Ti] are the weight % of the corresponding alloying element.

The above Relationship Expression (2) is an expression which shows the relationship between the rolling finishing temperature and a component of the steel. In general, when the temperature of the steel material is lowered to a certain critical temperature or lower during hot rolling, the recrystallization delay phenomenon of the steel material occurs, and the blanking characteristics of the steel material are improved through the effect of grain refinement, or the like. Therefore, when the rolling finishing temperature (FDT) of the steel is controlled to be the critical rolling temperature (Tn) or lower, the average packet size of the martensite phase in the microstructures of the manufactured steel is 1 to 7 μm in a circle-equivalent diameter to increase the punchability of the steel through grain refinement.

However, if the rolling finishing temperature (FDT) is excessively lowered, there is a problem in the sheet-feeding mechanism in the rolling process, and excessive partial recrystallization occurs only in the surface layer part, which causes a decrease in the blanking properties due to the difference in the physical properties in the thickness direction of the steel. Therefore, by adjusting the rolling finishing temperature (FDT) of the steel to be Tn−70 or higher, controlling the aspect ratio of the packet structure of the martensite phase to be 1 to 5 in the central part (t/4 to t/2) in the thickness direction and 1.1 to 6 in the surface layer part (surface layer to t/8) in the thickness direction, and controlling the value obtained by dividing the aspect ratio of the surface layer part by the aspect ratio of the central part to be 0.9 to 2, the blanking properties and uniformity of steel may be improved.

Cooling and Coiling

The rolled steel sheet is cooled to a temperature in the range of 0 to 400° C. at an average cooling rate of 5 to 200° C./sec, and is coiled at a temperature in the range of 0 to 400° C., and the cooling rate of the steel sheet at this time is set to satisfy the following Relationship Expression (3) according to the component of steel grade.

$$LCR \le CR \le HCR,$$

$$LCR = 2000/(-1076+2751\times[C]+17\times[Si]+301\times[Mn]+330\times[Cr]+355\times[Mo]+42939\times[B])$$

$$HCR = 2500/(-70.3+198\times[C]+32.0\times[Si]+16.7\times[Mn]+18.4\times[Cr]+42.1\times[Mo]+5918\times[B]), \quad \text{[Relationship Expression (3)]}$$

where CR is the cooling rate (° C./s) in the cooling zone, LCR is a minimum critical cooling rate (° C./s), a minimum value thereof is 5 and a maximum value thereof is 45, and HCR is a maximum critical cooling rate (° C./s), a minimum value thereof is 50 and a maximum value thereof is 200, and [C], [Si], [Mn], [Cr], [Mo] and [B] are the weight % of the corresponding alloying element.

The above Relationship Expression (3) is an expression for the cooling conditions of the steel. The cooling conditions in the cooling zone determine the microstructure of the steel and have a dominant influence on strength and hardness. In addition, at this time, the cooling condition of the steel should consider the change in hardenability according to the amount of alloying element added. Therefore, it is essential to apply an optimum cooling rate according to the alloying elements contained in the steel.

To this end, in the present disclosure, the maximum critical cooling rate (HCR) and the minimum critical cooling rate (LCR) are respectively obtained by the addition amount of the alloying element, and the cooling rate (CR) in the cooling zone is provided to satisfy between the maximum critical cooling rate (HCR) and the minimum critical cooling rate (LCR). If the steel is cooled at a faster rate than the maximum critical cooling rate (HCR), the martensitic structure having a hard but poor brittleness characteristic is created, which reduces blanking properties, deteriorates the shape of the steel, and lowers uniformity due to a non-uniform amount of pouring water in all sections by excessive rapid cooling in the cooling zone. Conversely, if the cooling rate of the steel is slower than the minimum critical cooling rate (LCR), a ferrite phase having relatively low hardness is generated by 10% or more, which lowers the hardness of the steel, and the amount of ferrite produced reacts too sensitively to the change of the cooling rate, deteriorating material uniformity. Therefore, the cooling rate (CR) in the cooling zone may preferably be set to a value between the maximum critical cooling rate (HCR) and the minimum critical cooling rate (LCR).

MODE FOR INVENTION

Example

Hereinafter, an embodiment of the present disclosure will be described in more detail through examples. However, it is necessary to note that the following examples are only intended to illustrate the present disclosure in more detail and are not intended to limit the scope of the present disclosure. This is because the scope of the present disclosure is determined by the matters described in the claims and matters reasonably inferred therefrom.

First, a steel slab satisfying the component system illustrated in Table 1 below was heated to 1200° C., and the high-strength hot-rolled steel sheet was manufactured under the hot rolling conditions illustrated in Table 2. The high-strength hot-rolled steel sheet thus prepared was tested to measure the microstructure, strength, hardness, and blanking properties, and the results are summarized in Tables 2 and 4 below.

The fractions of respective components in Table 1 below are weight %, and the meanings of FDT, Tn, CR, LCR, and HCR in Table 2 below are as follows. In addition, in the fraction of microstructure, Fer indicates ferrite, Bai indicates bainite, and Mar indicates martensite. When the fraction of each microstructure satisfies the target level, an 'O' mark is indicated, and when not, an 'X' mark is indicated.

FDT: Rolling finishing temperature (° C.)

Tn: Critical rolling temperature (° C.)

CR: Cooling rate in the cooling zone (° C./s)

LCR: Minimum critical cooling rate (° C./s)

HCR: Maximum critical cooling rate (° C./s)

In addition, for the inventive steel and comparative steel, the packet structure of the martensite phase was observed in the central part in the thickness direction and the surface layer part in the thickness direction, and each packet was simplified in the form of an ellipse. In this case, the aspect ratio obtained by dividing a length of a long axis of the ellipse by a length of a short axis thereof was measured and the measurement results are illustrated in Table 3 below. When the packet size and the aspect ratio of the martensite phase satisfy the target level, an 'O' mark was indicated for satisfaction, and when not, an 'X' mark was indicated, and such structural defects occur when the manufacturing conditions illustrated in Table 2 do not satisfy the target relational expression, and appear as results of excessively fine/coarse martensitic structures or of increasing deviation in thickness direction.

The tensile strength in Table 4 below is the total average of values obtained by measuring the tensile strength or Rockwell hardness at uniform intervals in 9 sites of the total width and 3 sites in the total length of the coil-shaped hot-rolled steel sheet after coiling. The tensile strength was measured once for each location, and the hardness was measured 10 times for each location. The deviation of tensile strength indicates the difference between maximum and minimum values among the measured values.

CL represents the effective cracking index, and when cracks of an effective size occur when punching steel, it is indicated by ‘’ for satisfaction of blanking properties, and indicated by ‘X’ if not.

TABLE 1

| Specimen | C | Si | Mn | Cr | Mo | Al | P | S | N | B | Ti | Nb |
|---|---|---|---|---|---|---|---|---|---|---|---|---|
| Comparative steel1 | 0.080 | 0.100 | 1.400 | 0.400 | 0.002 | 0.002 | 0.003 | 0.003 | 0.002 | 0.002 | 0.015 | 0.001 |
| Comparative steel2 | 0.295 | 0.050 | 1.200 | 0.300 | 0.100 | 0.002 | 0.003 | 0.003 | 0.003 | 0.002 | 0.015 | 0.001 |
| Comparative steel3 | 0.160 | 0.040 | 1.800 | 0.200 | 0.200 | 0.200 | 0.002 | 0.002 | 0.002 | 0.001 | 0.002 | 0.001 |
| Comparative steel4 | 0.180 | 0.500 | 1.350 | 0.060 | 0.200 | 0.010 | 0.002 | 0.004 | 0.003 | 0.001 | 0.010 | 0.050 |
| Comparative steel5 | 0.195 | 0.150 | 1.500 | 0.100 | 0.100 | 0.010 | 0.003 | 0.003 | 0.003 | 0.001 | 0.020 | 0.010 |
| Comparative steel6 | 0.170 | 0.300 | 2.200 | 0.100 | 0.050 | 0.002 | 0.003 | 0.002 | 0.004 | 0.001 | 0.015 | 0.015 |
| Comparative steel7 | 0.190 | 0.300 | 1.500 | 1.480 | 0.010 | 0.002 | 0.003 | 0.002 | 0.002 | 0.001 | 0.015 | 0.015 |
| Comparative steel8 | 0.270 | 0.100 | 1.600 | 0.700 | 0.010 | 0.002 | 0.003 | 0.002 | 0.002 | 0.002 | 0.015 | 0.020 |
| Inventive steel1 | 0.210 | 0.002 | 1.400 | 0.002 | 0.200 | 0.002 | 0.003 | 0.002 | 0.002 | 0.0015 | 0.025 | 0.002 |
| Inventive steel2 | 0.210 | 0.002 | 1.800 | 0.002 | 0.002 | 0.003 | 0.002 | 0.003 | 0.003 | 0.0015 | 0.025 | 0.002 |
| Inventive steel3 | 0.195 | 0.100 | 1.250 | 0.600 | 0.200 | 0.002 | 0.003 | 0.003 | 0.002 | 0.0015 | 0.015 | 0.020 |
| Inventive steel4 | 0.195 | 0.100 | 1.100 | 0.800 | 0.200 | 0.003 | 0.003 | 0.004 | 0.002 | 0.0015 | 0.015 | 0.020 |
| Inventive steel5 | 0.210 | 0.003 | 1.250 | 0.800 | 0.200 | 0.003 | 0.004 | 0.002 | 0.003 | 0.0015 | 0.015 | 0.020 |
| Inventive steel6 | 0.210 | 0.002 | 1.400 | 0.400 | 0.200 | 0.004 | 0.002 | 0.002 | 0.003 | 0.0015 | 0.015 | 0.020 |
| Inventive steel7 | 0.210 | 0.003 | 1.400 | 0.800 | 0.200 | 0.002 | 0.002 | 0.001 | 0.002 | 0.0015 | 0.015 | 0.002 |
| Inventive steel8 | 0.230 | 0.100 | 1.400 | 0.800 | 0.200 | 0.002 | 0.001 | 0.003 | 0.002 | 0.0015 | 0.015 | 0.020 |

TABLE 2

| | Rolling conditions (Relationship Expression 2) | | | Cooling conditions (Relationship Expression 3) | | | Microstructure Fraction | | | |
|---|---|---|---|---|---|---|---|---|---|---|
| Specimen | Tn-70 | FDT | Tn | LCR | CR | HCR | Fer | Bai | Mar | Satisfied or Not Satisfied |
| Comparative steel1 | 833 | 880 | 903 | 5 | 45 | 50 | 0.05 | 0.08 | 0.87 | ○ |
| Comparative steel2 | 779 | 860 | 849 | 5 | 65 | 80 | 0.08 | 0.12 | 0.80 | ○ |
| Comparative steel3 | 803 | 790 | 873 | 23 | 145 | 200 | 0.02 | 0.10 | 0.88 | ○ |
| Comparative steel4 | 830 | 850 | 900 | 5 | 140 | 129 | 0.00 | 0.02 | 0.98 | X |
| Comparative steel5 | 805 | 840 | 875 | 45 | 40 | 200 | 0.15 | 0.25 | 0.60 | X |
| Comparative steel6 | 797 | 830 | 867 | 13 | 100 | 128 | 0.00 | 0.11 | 0.89 | ○ |
| Comparative steel7 | 795 | 840 | 865 | 5 | 65 | 70 | 0.01 | 0.14 | 0.85 | ○ |
| Comparative steel8 | 772 | 830 | 842 | 5 | 60 | 65 | 0.01 | 0.09 | 0.89 | ○ |
| Inventive steel1 | 800 | 850 | 870 | 34 | 80 | 200 | 0.01 | 0.10 | 0.89 | ○ |
| Inventive steel2 | 786 | 850 | 856 | 18 | 120 | 200 | 0.02 | 0.15 | 0.83 | ○ |
| Inventive steel3 | 806 | 870 | 876 | 12 | 110 | 121 | 0.01 | 0.11 | 0.88 | ○ |
| Inventive steel4 | 808 | 870 | 878 | 10 | 80 | 114 | 0.01 | 0.20 | 0.79 | ○ |
| Inventive steel5 | 796 | 800 | 866 | 7 | 95 | 103 | 0.00 | 0.12 | 0.88 | ○ |
| Inventive steel6 | 797 | 800 | 867 | 10 | 100 | 129 | 0.00 | 0.13 | 0.87 | ○ |
| Inventive steel7 | 791 | 830 | 861 | 6 | 80 | 93 | 0.01 | 0.11 | 0.89 | ○ |
| Inventive steel8 | 790 | 820 | 860 | 5 | 70 | 74 | 0.01 | 0.16 | 0.84 | ○ |

TABLE 3

| | | Aspect ratio of packet structure of martensite phase | | | |
|---|---|---|---|---|---|
| Specimen | Average packet size of martensite phase (μm) | Central part in thickness direction (t/4~t/2) | Surface layer part in thickness direction (Surface layer~t/2) | Aspect ratio of surface layer part/ aspect ratio of central part | Satisfied or Not Satisfied |
| Comparative steel1 | 3.14 | 3.71 | 4.00 | 1.07 | ○ |
| Comparative steel2 | 7.08 | 2.89 | 3.21 | 1.10 | X |
| Comparative steel3 | 2.37 | 3.14 | 8.44 | 2.68 | X |
| Comparative steel4 | 4.47 | 3.88 | 4.28 | 1.10 | ○ |
| Comparative steel5 | 3.74 | 4.54 | 4.81 | 1.06 | ○ |
| Comparative steel6 | 4.88 | 4.98 | 5.14 | 1.0 | ○ |
| Comparative steel7 | 6.14 | 3.04 | 5.12 | 1.68 | ○ |
| Comparative steel8 | 5.77 | 4.87 | 5.87 | 1.20 | ○ |
| Inventive steel1 | 4.15 | 3.81 | 4.11 | 1.08 | ○ |
| Inventive steel2 | 5.12 | 4.11 | 4.51 | 1.09 | ○ |
| Inventive steel3 | 4.36 | 4.12 | 4.71 | 1.14 | ○ |
| Inventive steel4 | 4.87 | 3.71 | 4.72 | 1.27 | ○ |
| Inventive steel5 | 3.54 | 4.12 | 5.11 | 1.24 | ○ |

TABLE 3-continued

| Specimen | Average packet size of martensite phase (μm) | Aspect ratio of packet structure of martensite phase: Central part in thickness direction (t/4~t/2) | Surface layer part in thickness direction (Surface layer~t/2) | Aspect ratio of surface layer part/ aspect ratio of central part | Satisfied or Not Satisfied |
|---|---|---|---|---|---|
| Inventive steel6 | 3.81 | 4.47 | 5.64 | 1.26 | ○ |
| Inventive steel7 | 4.12 | 3.81 | 5.07 | 1.33 | ○ |
| Inventive steel8 | 3.94 | 4.24 | 4.41 | 1.04 | ○ |

TABLE 4

| Specimen | Tensile strength (MPa) | Tensile strength deviation (Δ MPa) | Surface hardness (HRC) | Hardness deviation (Δ HRC) | CL (Relationship Expression 1) | Blanking property satisfied or not satisfied |
|---|---|---|---|---|---|---|
| Comparative steel1 | 984 | 51 | 35.1 | 1.8 | 0.56 | ○ |
| Comparative steel2 | 1901 | 121 | 52.9 | 5.1 | 1.12 | X |
| Comparative steel3 | 1336 | 131 | 42.0 | 7.2 | 0.82 | ○ |
| Comparative steel4 | 1345 | 98 | 42.1 | 5.2 | 0.73 | ○ |
| Comparative steel5 | 1085 | 54 | 37.1 | 2.1 | 0.81 | ○ |
| Comparative steel6 | 1436 | 66 | 43.9 | 2.3 | 1.07 | X |
| Comparative steel7 | 1476 | 72 | 44.7 | 2.2 | 1.04 | X |
| Comparative steel8 | 1776 | 124 | 50.5 | 6.7 | 1.16 | X |
| Inventive steel1 | 1443 | 62 | 44.0 | 1.8 | 0.80 | ○ |
| Inventive steel2 | 1459 | 55 | 44.3 | 1.9 | 0.97 | ○ |
| Inventive steel3 | 1406 | 68 | 43.3 | 2.2 | 0.77 | ○ |
| Inventive steel4 | 1389 | 41 | 43.0 | 1.4 | 0.76 | ○ |
| Inventive steel5 | 1488 | 66 | 44.9 | 2.4 | 0.85 | ○ |
| Inventive steel6 | 1485 | 31 | 44.8 | 1.5 | 0.84 | ○ |
| Inventive steel7 | 1527 | 52 | 45.7 | 1.9 | 0.90 | ○ |
| Inventive steel8 | 1631 | 67 | 47.7 | 2.1 | 0.97 | ○ |

As can be seen from Tables 1 to 4, it can be seen that Inventive Steels 1 to 8 satisfy the alloy composition presented in the present disclosure, and thus all have a tensile strength of 1100 MPa or more and a surface hardness of 35 HRC or more.

However, Comparative Steel 1 had a carbon concentration of 0.08%, which fell short of the component range, and thus, the solid solution strengthening effect by C was insufficient, and thus the hardness and strength compared to the target were insufficient.

On the other hand, as a result of analyzing the comparative steel and the inventive steel using Relationship Expression (2), all the inventive steels satisfied Relationship Expression (2), and accordingly, the average packet size of the martensite phase was 1 to 7 μm in the circle-equivalent diameter, the aspect ratio of the packet structure of the martensite phase was 1 to 5 in the central part (t/4 to t/2) in the thickness direction and was 1.1 to 6 in the surface layer part (surface layer to t/8) in the thickness direction, and the value obtained by dividing the aspect ratio of the surface layer part by the aspect ratio of the central part satisfied 0.9 to 2. This was also confirmed through observation of the actual microstructure, and the results of EBSD analysis of the microstructure of the surface layer part and the central part of Inventive Steel 3 are representatively illustrated in FIG. 1.

However, the component range of each alloy component of Comparative Steel 2 satisfies the conditions of the present disclosure, but the Tn value is lower than usual, and thus the FDT is higher than Tn, such that the Relationship Expression (2) is not satisfied. Due to this high rolling finishing temperature, the martensitic structure of the surface layer and the deep layer was coarse, resulting in lowering of the blanking properties. In addition, in the case of Comparative Steel 3, the FDT temperature was lower than Tn−70 because the rolling was finished at an excessively low temperature, such that the Relationship Expression (2) was not satisfied. As a result, an excessively deformed microstructure was formed in the surface layer, and the blanking properties were reduced due to the microstructure deviation between the surface layer part and the central part, and the uniformity was reduced.

As a result of analyzing the comparative steel and the inventive steel using Relationship Expression (3), it was confirmed that all the inventive steels satisfy Relationship Expression (3), which is summarized and illustrated in Table 2. Therefore, in all inventive steels, a ferrite phase that lowers strength and hardness is not generated by 10% or more, and a hard but highly brittle martensite phase is not generated, and thus, a phenomenon in which blanking property is reduced did not occur.

However, in the case of Comparative Steel 4, the cooling rate was higher than the HCR value, and thus, the production amount of the ferrite phase or bainite phase was insufficient, and only the martensite phase with low brittleness characteristics was generated in a large amount. Accordingly, the blanking property was reduced, and it was difficult to uniformly control the cooling rate in the width direction in the cooling zone due to the excessively fast cooling rate, and thus the uniformity in the width direction was reduced. In addition, in the case of Comparative Steel 5, the cooling rate was slower than the LCR value, and thus, the Relationship Expression (2) was not satisfied. As a result, the cooling rate compared to the hardenability was excessively slow and a large amount of ferrite phase was contained, such that the strength and hardness were less than the target.

On the other hand, as a result of analyzing the comparative steel and the inventive steel using Relationship Expression (1), it was confirmed that all the inventive steels satisfy Relationship Expression (1), which is summarized and illustrated in Table 4. Therefore, it was confirmed that all inventive steels secured the target level of blanking properties, and that cracks at an effective level that had a fatal impact on product quality during punching processing for manufacturing real parts did not occur.

However, in the case of Comparative Steel 6, the Mn content was excessively high, and thus, Mn segregation was deepened, and thus the blanking properties were deteriorated. As a result, since the Relationship Expression (1) is not satisfied, it can be confirmed that the blanking property is inferior. Similarly, in the case of Comparative Steel 7, the content of Cr was excessively high, and Relationship Expression (1) was not satisfied. As a result, Cr segregation was deepened and the blanking properties were deteriorated.

On the other hand, Comparative Steel 8 contains a large amount of component systems such as C that hardens the steel, and thus has a component system with a significantly high hardness value. As a result, Relationship Expression (1) was not satisfied due to an excessive increase in hardness, and a number of effective cracks that had a fatal impact on product quality occurred during punching.

The invention claimed is:

1. A hot-rolled steel sheet, comprising:

by weight %, C: 0.10 to 0.30%, Si: 0.001 to 1.0%, Mn: 0.5 to 2.5%, Cr: 0.001 to 1.5%, Mo: 0.001 to 0.5%, Al: 0.001 to 0.5%, P: 0.001 to 0.01%, S: 0.001 to 0.01%, N: 0.001 to 0.01%, B: 0.0001 to 0.004%, Ti: 0.001 to 0.1%, and Nb: 0.001 to 0.1%, and comprising a balance of iron and unavoidable impurities, the hot-rolled steel sheet satisfying Relationship Expression (1), wherein in a microstructure, a main phase consists of a martensite phase and a bainite phase, a fraction of the martensite phase is 50% or more and less than 90%, a fraction of the bainite phase is 5% or more and 50% or less, a sum of the fractions of the martensite phase and the bainite phase is 90% or more, and a remainder is a ferrite phase,

[Relationship Expression (1)]

$CL<1$, in which $CL=-0.692-0.158\times[Mn]+0.121\times[Mn]^2+0.061\times[Cr]^2-0.319\times[Mo]+0.035\times[Hardness_HRC]$, where CL is an effective cracking index, [Mn], [Cr] and [Mo] are weight % of a corresponding alloying element, and [Hardness_HRC] is a Rockwell hardness (HRC).

2. The hot-rolled steel sheet of claim 1, wherein an average packet size of the martensite phase is 1 to 7 μm in a circle-equivalent diameter, an aspect ratio of a packet structure of the martensite phase is 1 to 5 in a central part (t/4 to t/2) in a thickness direction and is 1.1 to 6 in a surface layer part (surface layer to t/8) in the thickness direction, and a value obtained by dividing the aspect ratio of the surface layer part in the thickness direction by the aspect ratio of the central part in the thickness direction is 0.9 to 2.

3. The hot-rolled steel sheet of claim 1, wherein the hot-rolled steel sheet has a tensile strength of 1100 MPa or more and a surface hardness of 35 HRC or more.

4. The hot-rolled steel sheet of claim 3, wherein when the tensile strength and the surface hardness were measured at 9 sites in a total width and 3 sites in a total length of a coiled hot-rolled steel sheet, a difference between a maximum value and a minimum value of each measurement result is within 140 MPa of tensile strength and within 4 HRC of surface hardness.

5. A method of manufacturing a hot-rolled steel sheet, comprising:

reheating a steel slab satisfying the following Relationship Expression (1) to 1180-1350° C., the steel slab comprising, by weight %, C: 0.10 to 0.30%, Si: 0.001 to 1.0%, Mn: 0.5 to 2.5%, Cr: 0.001 to 1.5%, Mo: 0.001 to 0.5%, Al: 0.001 to 0.5%, P: 0.001 to 0.01%, S: 0.001 to 0.01%, N: 0.001 to 0.01%, B: 0.0001 to 0.004%, Ti: 0.001 to 0.1%, Nb: 0.001 to 0.1%, and balances of iron and unavoidable impurities;

hot rolling the reheated steel slab to satisfy the following Relationship Expression (2);

cooling a hot-rolled steel sheet to a temperature in a range of 0 to 400° C. to satisfy the following Relationship Expression (3); and coiling the cooled steel sheet at a temperature in a range of 0 to 400° C., $$CL<1,$$

$$CL=-0.692-0.158\times[Mn]+0.121\times[Mn]^2+0.061\times[Cr]^2-0.319\times[Mo]+0.035\times[Hardness_HRC], \quad \text{Relationship Expression (1):}$$

where CL is an effective cracking index, [Mn], [Cr] and [Mo] are weight % of a corresponding alloying element, and [Hardness_HRC] is a Rockwell hardness (HRC), $$Tn-70\leq FDT\leq Tn,$$

$$Tn=967-280\times[C]+35.7\times[Si]-28.1\times[Mn]-11.4\times[Cr]+11.4\times[Mo]-62\times[Ti]+46.2\times[Nb], \quad \text{Relationship Expression (2):}$$

where Tn is a critical rolling temperature (° C.), FDT is a rolling finishing temperature (° C.), and [C], [Si], [Mn], [Cr], [Mo], [B], [Nb] and [Ti] are weight % of a corresponding alloying element, and $$LCR\leq CR\leq HCR,$$

$$LCR=2000/(-1076+2751\times[C]+17\times[Si]+301\times[Mn]+330\times[Cr]+355\times[Mo]+42939\times[B])$$

$$HCR=2500/(-70.3+198\times[C]+32.0\times[Si]+16.7\times[Mn]+18.4\times[Cr]+42.1\times[Mo]+5918\times[B]) \quad \text{Relationship Expression (3):}$$

where CR is a cooling rate (° C./s) in a cooling zone, LCR is a minimum critical cooling rate (° C./s), a minimum value thereof is 5 and a maximum value thereof is 45, HCR is a maximum critical cooling rate (° C./s), a minimum value thereof is 50 and a maximum value thereof is 200, and [C], [Si], [Mn], [Cr], [Mo] and [B] are weight % of a corresponding alloying element.

6. The method of manufacturing a hot-rolled steel sheet of claim 5, wherein after the coiling, the hot-rolled steel sheet is pickled and then lubricated.

* * * * *